United States Patent [19]

Clarkson

[11] 3,990,189

[45] Nov. 9, 1976

[54] SANDING MACHINE FOR FINISHING GROOVES

[76] Inventor: William C. Clarkson, 8430 Birchcroft, Dallas, Tex. 75231

[22] Filed: June 4, 1975

[21] Appl. No.: 583,694

[52] U.S. Cl. ..... 51/76 R; 51/138; 144/136 R

[51] Int. Cl.[2] ..... B24B 7/28; B24B 19/24

[58] Field of Search ..... 51/74, 76 R, 78, 80 A, 51/99, 137–139, 147; 144/136 R

[56] References Cited

UNITED STATES PATENTS

| | | | |
|---|---|---|---|
| 971,114 | 9/1910 | Breckenkamp | 51/147 |
| 2,197,287 | 4/1940 | Almendinger | 51/99 |
| 2,505,788 | 5/1950 | Norquist | 51/76 R X |
| 2,554,079 | 5/1951 | Wilson | 51/76 R |
| 3,738,064 | 6/1973 | Szyferblatt | 51/99 X |

*Primary Examiner*—Al Lawrence Smith
*Assistant Examiner*—Nicholas P. Godici
*Attorney, Agent, or Firm*—Richards, Harris and Medlock

[57] ABSTRACT

An improved sander apparatus having a work surface with a conveyor for translating the workpiece across the work surface, and sanding apparatus positioned above the work surface for sanding grooves in the workpiece parallel to the direction of the movement of the workpiece. The sanding apparatus has a pair of spaced parallel shafts extending transversely to the direction of travel of the workpiece and a plurality of sanding assemblies rotatably supported from the shafts. The sanding assemblies each have a sanding wheel contoured to mate with a groove in the workpiece. A motor is mounted on each sanding assembly to rotate the sanding wheel. A variable length link supports each sanding assembly and can be adjusted to control the position of the sanding wheel with respect to the workpiece.

2 Claims, 9 Drawing Figures

SANDING MACHINE FOR FINISHING GROOVES

BACKGROUND OF THE INVENTION

The present invention relates generally to improvements in sanding apparatus. In another aspect, this invention relates to a new and improved sanding apparatus for sanding grooves in the surface of the workpiece.

DESCRIPTION OF THE PRIOR ART

In the manufacture of panels, drawer fronts, cabinet doors, and the like, for residential and industrial use, it has been a common practice to form a plurality of decorative grooves therein extending across the faces thereof. These grooves typically have ornamental contoured cross sectional shapes. It has been conventional to form these contoured grooves by means of commercially available tools. The finishing of these grooves, however, has presented a difficult problem and has conventionally involved manual sanding of the grooves.

Therefore, according to the present invention, an improved sanding apparatus is provided which can automatically sand a plurality of contoured grooves in a workpiece.

More particularly, an improved sanding apparatus is provided having a work table with a conveyor means for moving workpieces transversely across the surface of the work table. Guides are provided on the work table for positioning the workpiece as it moves across the table. Sanding assemblies are supported above the work table for each of the grooves to be sanded. Each assembly has a frame mounted to rotate about a horizontal axis. A motor is mounted on the frame. A sanding wheel contoured to match the respective groove is rotatably attached to the extending end of the frame and connected to and driven by the motor. A variable length link allows adjustment of the position of the wheel with respect to the workpiece.

BRIEF DESCRIPTION OF THE DRAWINGS

The objects and many of the attendant advantages of the present invention will be readily appreciated by those of ordinary skill in the art as the same becomes better understood by reference to the following detailed description when considered in connection with the accompanying Drawings in which.

DESCRIPTION OF THE PREFERRED EMBODIMENT

Figure 1:
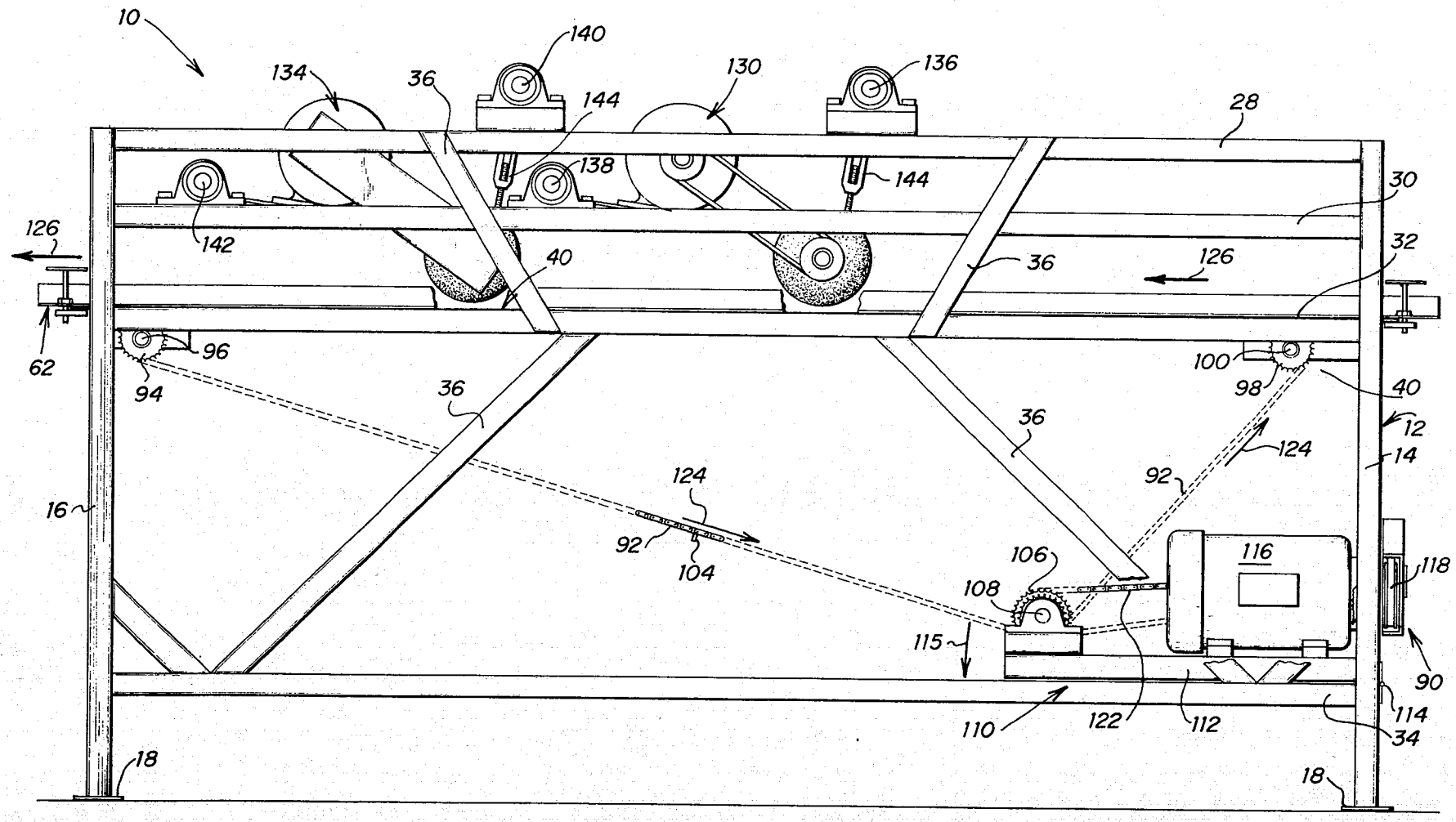
FIG. 1 is a left side elevation of the improved sander apparatus of the present invention.
Figure 2:
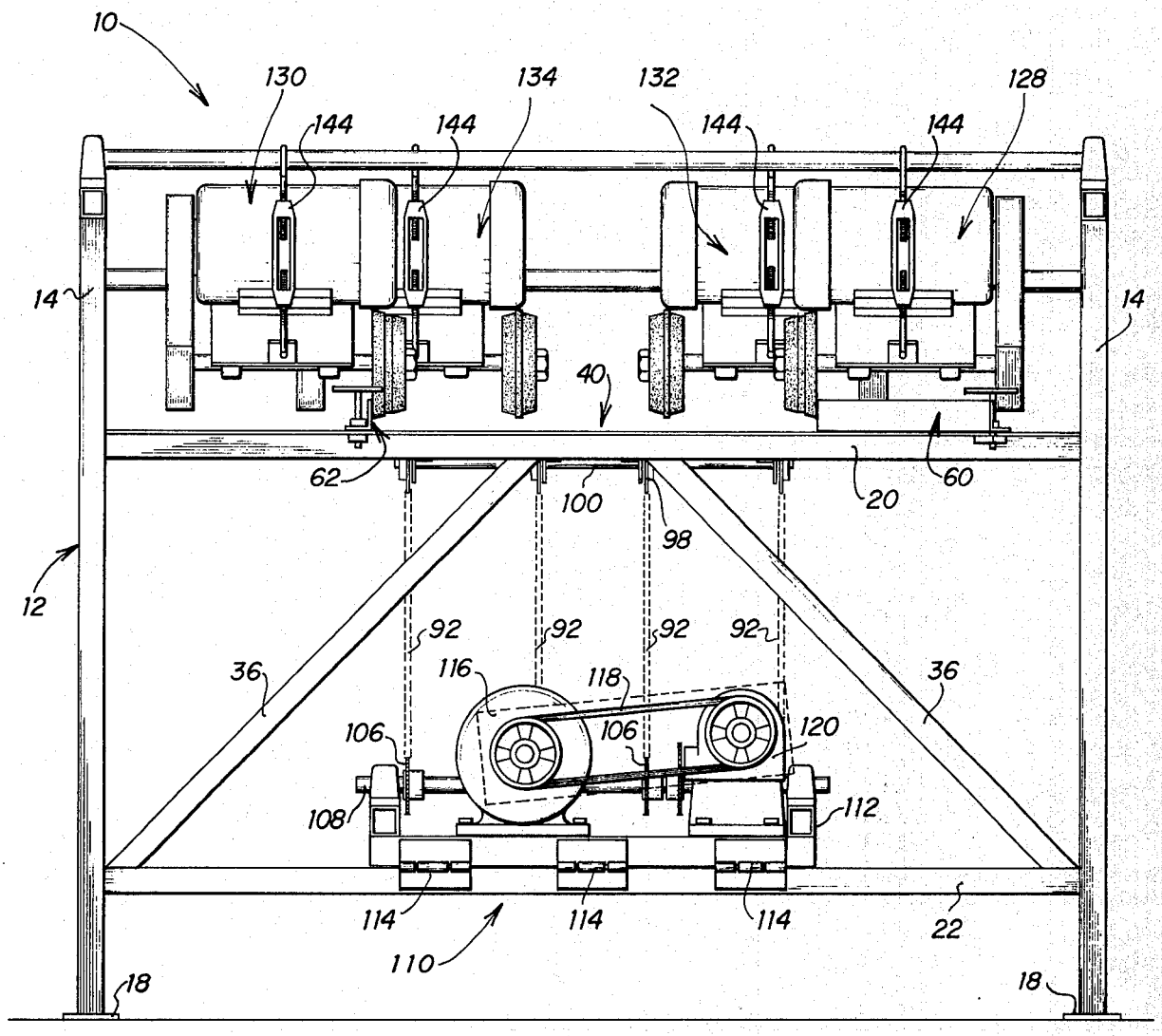
FIG. 2 is a front elevation of the apparatus.

Referring now to the Drawings, wherein like reference characters designate like or corresponding parts throughout the several views, there is shown an improved sander apparatus of the present invention, which for purposes of description is identified generally by reference numeral 10. Apparatus 10 is utilized to sand contoured grooves in panels and the like.

Apparatus 10 has a frame 12 with two front legs 14 and two rear legs 16. Each leg has pads 18 formed thereon for supporting and/or attaching the apparatus to the floor. Legs 14 and 16 can be formed from tubular stock cut to the desired length. A pair of parallel spaced horizontally extending cross braces 20 and 22 rigidly interconnect legs 14. In a likewise manner, cross braces 24 and 26 extend between legs 16.

Front and rear legs 14 and 16, respectively, are interconnected by a plurality of parallel spaced horizontally extending side braces 28, 30, 32 and 34. Side braces 34 are on the same horizontal level with braces 22 and 26 while side braces 32 are on the same horizontal level with braces 20 and 24. Gusset braces 36 are provided about the frame to reinforce the frame. In the preferred embodiment, frame 12 is formed from metallic material with the various components being welded together, it being understood, of course, that other assembly techniques could be used which are well-known in the art.

Figure 4:
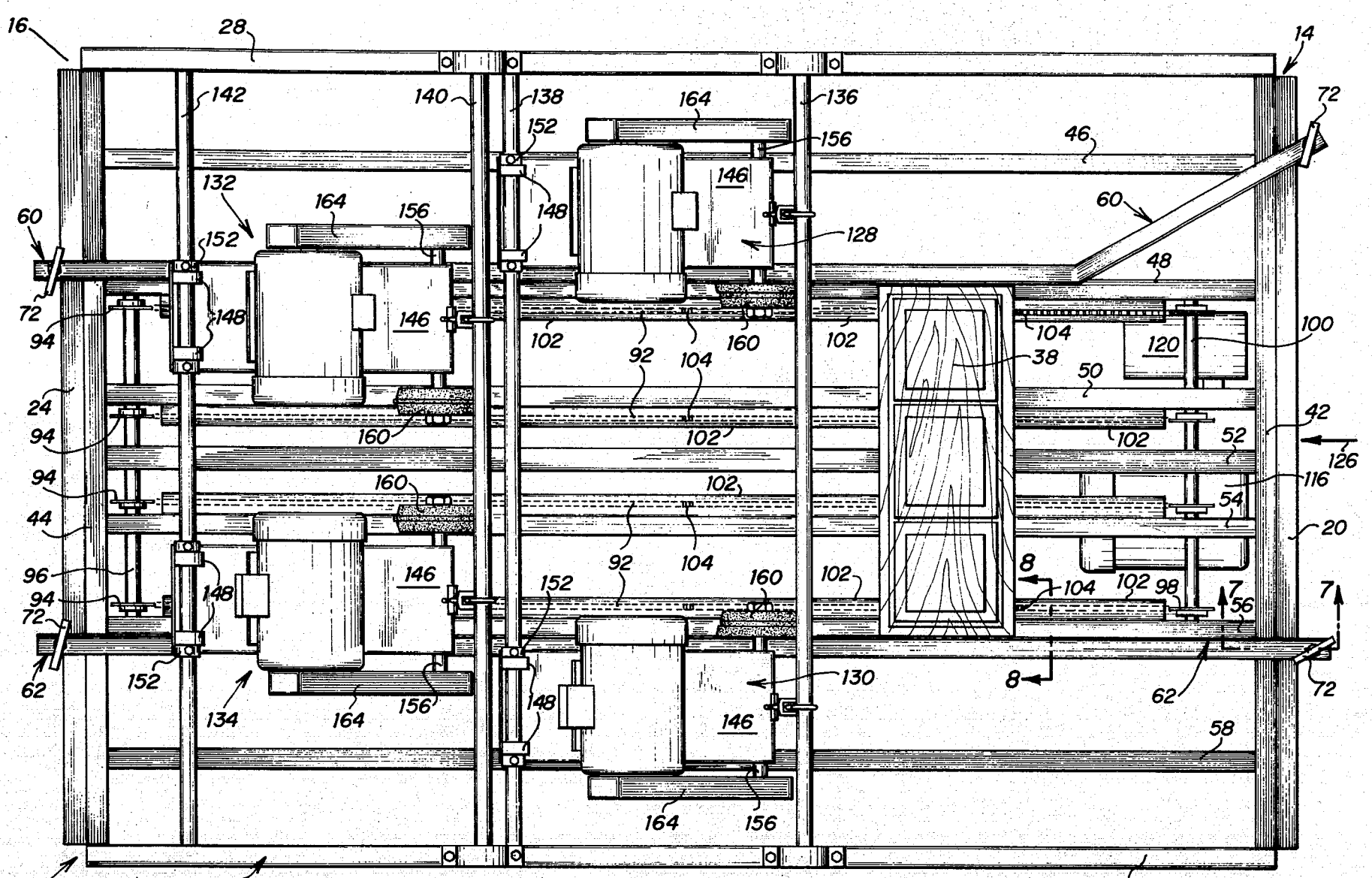
FIG. 4 is a plan view of the apparatus.
Figure 9:
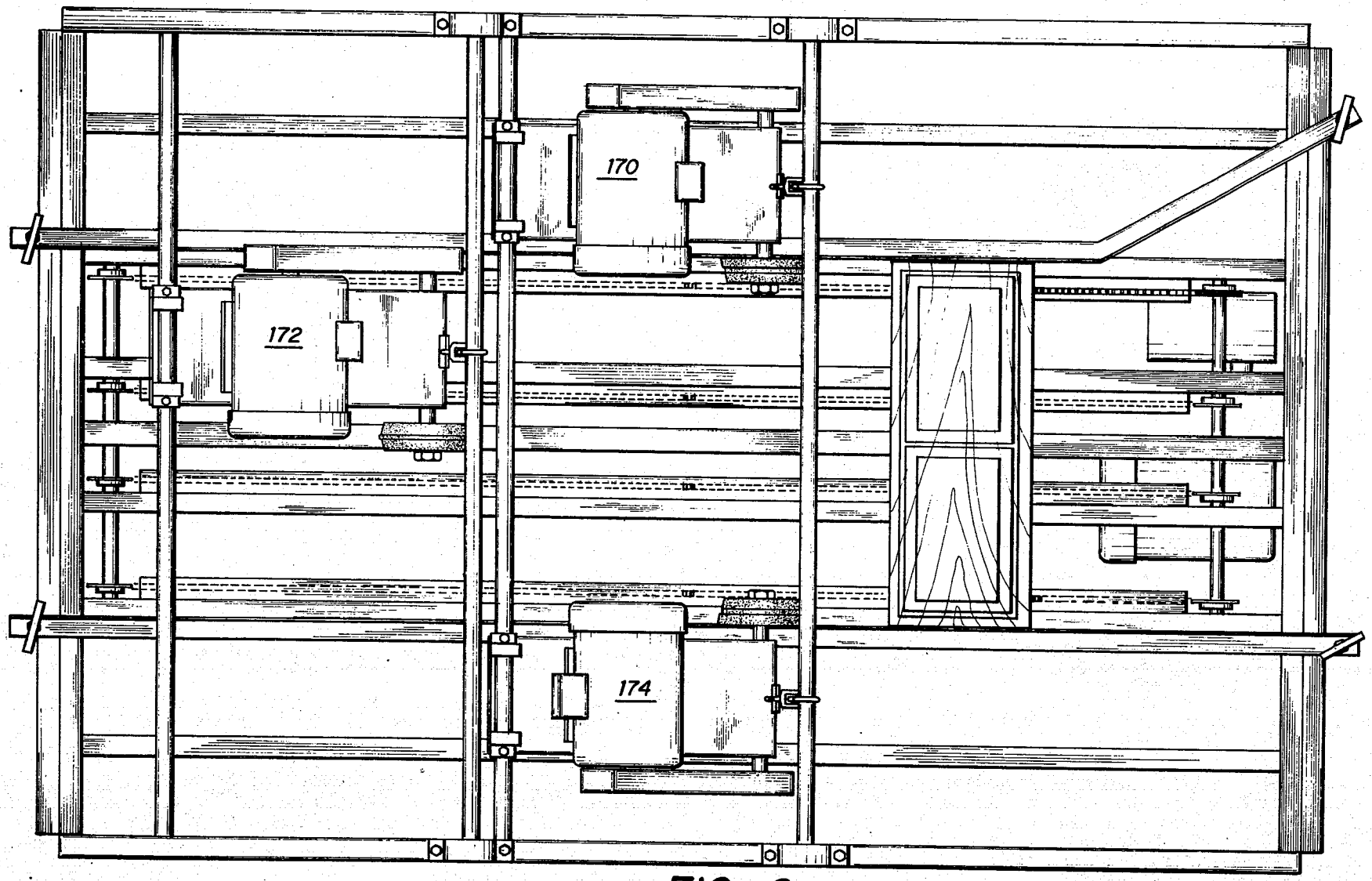
FIG. 9 is a plan view of an alternate embodiment of the present invention.

A work surface 40 is formed on the frame 12 at the level of braces 20, 32 and 24. Work surface 40 is defined by a flange on braces 20 and 24 and a flange on angle iron 42 fastened to brace 20 and by a flange on angle iron 44 fastened to brace 24. A plurality of parallel plates 46, 48, 50, 52, 54, 56 and 58 extend between angle irons 42 and 44. These plates are best shown in FIG. 4, and are positioned with their upper surfaces lying in the work surface plane along which workpieces slide during the sanding operation.

Figure 7:
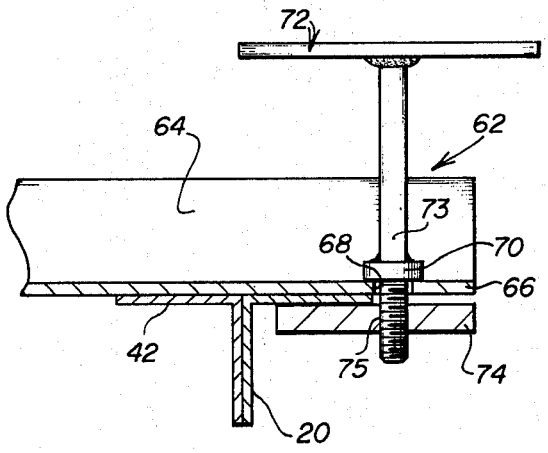
FIG. 7 is a section view taken on line 7—7 of FIG. 4, looking in the direction of the arrows.

A pair of guide assemblies 60 and 62 are releasably attached on the work surface. These guides are formed from angle irons with one flange extending vertically from the work surface and the other flange lying flush on the work surface. The mounting of the ends of assemblies 60 and 62 is typically shown in FIG. 7 with reference to assembly 62. As can be seen, an angle iron 64 has one flange lying flush on the upper surface of brace 20 with one end 66 extending beyond the side of brace 20. A bore 68 is formed in iron 64 adjacent end 66. A screw assembly 72 has a threaded shaft 73 which extends through bore 68. A collar 70 is affixed to shaft 73 to contact the upper surface of iron 64. A clamping plate 74 is positioned below the brace 20 and is provided with a threaded bore 75 for threaded engagement with shaft 73.

If it is desired to fix assembly 60 in position, screw assembly 72 is rotated to compress brace 20 between iron 64 and plate 74. This construction is typical at both ends of assemblies 60 and 62. Thus, it can be seen by selectively tightening or loosening assembly 72 that the separation and position of the ends of assemblies 60 and 62 can be set as desired.

Figure 8:
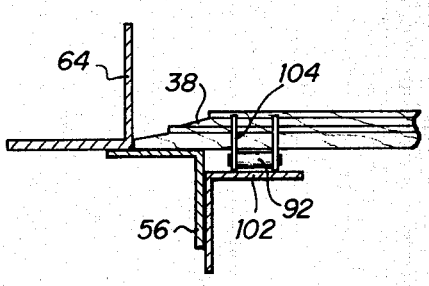
FIG. 8 is a section view taken on line 8—8 of FIG. 4, looking in the direction of the arrows.

A conveyor assembly 90 is positioned below work surface 40 for conveying the workpieces therealong. Conveyor assembly 90 has a plurality of parallel spaced endless chains 92. Chains 92 engage sprockets 94 carried by horizontally extending shaft 96 adjacent to plate 44. Chains 92 extend along the length of work surface 4 and engage a second set of sprockets 98 carried by a shaft 100. A plurality of horizontally extending plates 102 are attached to the frame below the chains 92 and extend along the path of travel of chains between the sprockets 94 and 98. Chains 92 rest on plates 102 as can be seen in FIG. 8 and are provided with tabs 104 for engaging workpiece 38 and pushing the same along the work surface 40.

Chains 92 also engage a plurality of sprockets 106 on a shaft 108 mounted on a drive assembly 110. Drive assembly 110 comprises a frame 112 which is pivotally connected at 114 by hinges to frame 12. A suitable driving means such as, motor 116, is mounted on frame 112 with the weight of the motor tending to rotate frame 112 in the direction of arrow 115. This rotation tends to tension the chains 92. An endless belt 118 connects motor 116 to a right angle gear box 120. Gear box 120 is in turn connected to drive shaft 108 by means of endless chain 122. Motor 116 thus drives chains 92 in the direction of arrow 124, causing the tabs 104 to move along the length of surface 40 in the direction of arrow 126 and conveying workpiece 38 along the length of the work surface in the same direction.

Suspended above the work surface 40 are four sanding assemblies 128, 130, 132, and 134. These assemblies are suspended above surface 40 by four separate shafts 136, 138, 140 and 142. These shafts extend parallel to each other across the width of the surface 40 and are supported from side braces 28 and 30.

As will be hereinafter described in detail, each assembly 128–134 has a frame which is supported from shafts 136 and 142. In the embodiment illustrated in FIG. 4, assemblies 128 and 130 are each pivotally supported at one end from shaft 138 and have turn buckle assemblies 144 supporting the other end at their frames from shaft 136. Assemblies 132 and 134 are pivotally supported from shaft 142 with turn buckle assemblies 144 supporting the assemblies from shafts 140.

Figure 5:
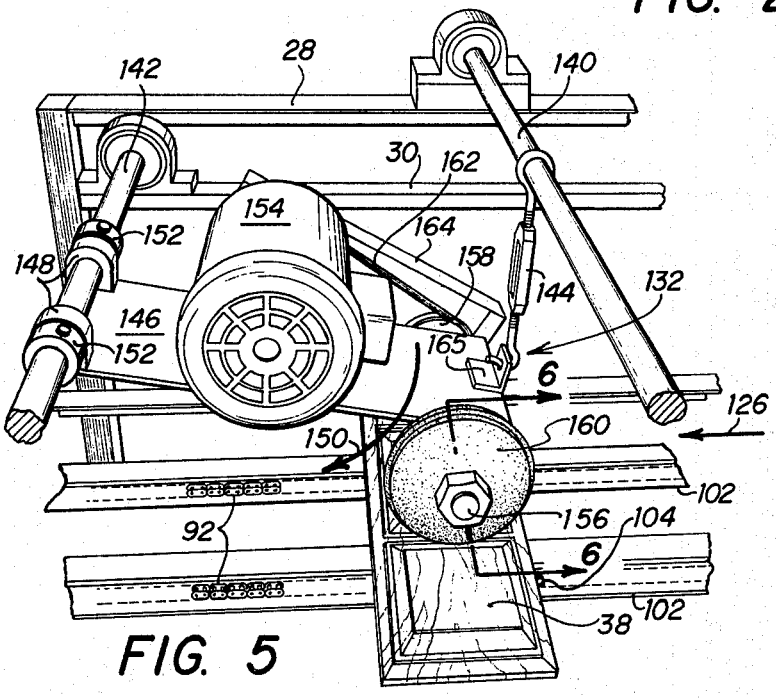
FIG. 5 is a partial perspective view of an individual sanding assembly of the improved sander apparatus of the present invention.

In FIG. 5, a typical mounting of the assemblies is illustrated in detail with respect to assembly 132. Assembly 132 has a frame 146 with a pair of bushings 148 mounted thereon. Bushings 148 are positioned around shaft 142 to allow frame 146 to rotate about shaft 142 in the forward and reverse directions of arrow 150. A pair of sleeves 152 with set screws therein are positioned outside bushings 148 on the shaft 142. By tightening and loosening the set screws in these sleeves, the position of assembly 132 on shaft 142 can be set as desired.

A motor 154 is mounted on frame 146. A shaft 156 is mounted on frame 146 parallel to the shaft of motor 154 and positioned at the end of the frame opposite bushings 148. Shaft 156 carries a pulley 158 at one end and an abrasive wheel 160 at the other. An endless belt 162 is connected between the pulley 158 and a pulley on the drive shaft of motor 154. In this manner, motor 154 rotates abrasive wheel 160. A guard 164 covers endless belt 162. A tab 165 is formed on the end of frame 146 adjacent to shaft 156. A conventional turn buckle assembly 144 suports frame 146 from shaft 140. By adjusting the length of the turn buckle 144, the height of wheel 160 can be adjusted. The construction of assembly 132 is typical of the construction.

Figure 6:
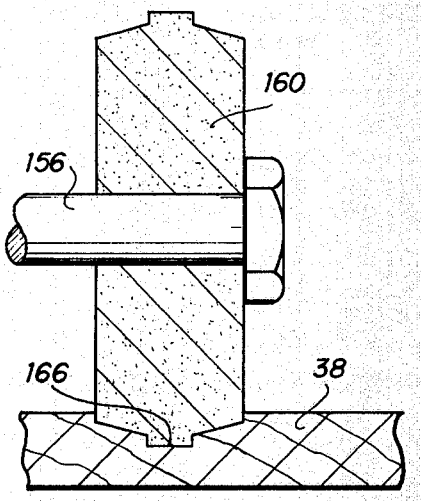
FIG. 6 is a section view taken on line 6—6 of FIG. 5, looking in the direction of the arrows.
Figure 3:
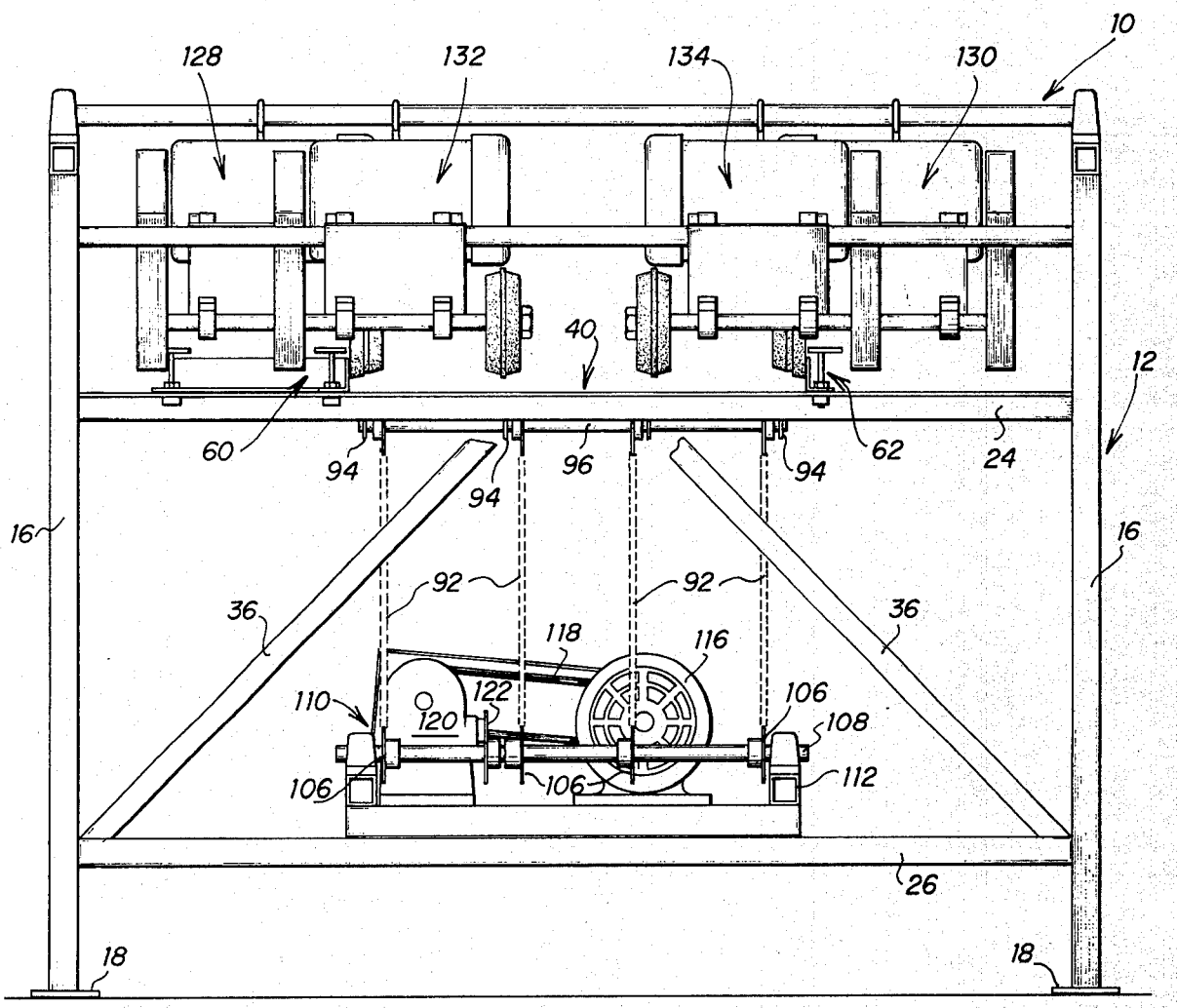
FIG. 3 is a rear elevation of the apparatus.

The details of construction of wheel 160 and its sanding of workpiece 38 is shown in detail in FIG. 6. As can be seen in this FIG., workpiece 38 has a contoured groove 166 formed therein. The wheel 160 is correspondingly contoured to sand groove 166 as shown. Wheel 160 is formed from a resilient cylindrical molded abrasive wheel which has been formed by gluing abrasive paper in groove 166 and passing wheel 160 thereover. It is envisioned, of course, that other shapes and contours could be formed on the wheel when sanding edges, grooves, and other contours of the workpiece 38.

In operation, the individual sanding assemblies are positioned above work surface 40 by sleeves 152 and turn buckles 144. Wheels 160 are positioned to engage grooves 166 and the edges to be sanded in the workpiece.

In the present embodiment, four separate sanding assemblies are illustrated, it being understood, of course, that more or less assemblies could be provided such as shown in FIG. 8, wherein three sanding assemblies 170, 172, and 174 are provided to sand the grooves of a workpiece.

From the foregoing, it will be understood that the preferred embodiment of the present invention includes an improved sanding apparatus which can be used to automatically sand and finish complex cross-section grooves formed in panels and other wood products, and the like. According to the preferred embodiment, sanding apparatus for sanding the grooves are supported in a manner which allows versatile adjustment of the position of the sanding apparatus both vertically and horizontally on the workpiece.

It is to be understood, of course, that the foregoing disclosure relates only to a preferred embodiment of the present invention, and that numerous alterations may be utilized to practice the present invention without departing from the spirit and scope of the invention as defined in the appended claims.

I claim:

1. A sander for use in finishing shaped grooves extending across a workpiece comprising in combination:

a horizontally extending work surface;

an endless conveyor extending along the length of said work surface having tabs thereon for engaging said workpieces and moving said workpieces through a sanding station on said horizontal work surface with said grooves aligned parallel to the direction of movement;

a cylindrical sanding wheel having a periphery formed to match said groove;

a rotatable shaft attached to said sanding wheel;

a frame rotatably supporting said shaft at one end of said frame for rotation about a horizontal axis;

a pulley on said shaft spaced away from said sanding wheel;

a motor mounted on said frame with the drive shaft of said motor coupled to said pulley by means of an endless belt to thereby rotate said shaft and said sanding wheel, a horizontally extending shaft supported above the work surface, means for mounting said frame at the end opposite said wheel to rotate about said horizontally extending shaft, a collar on said frame for engaging said horizontally extending shaft for rotation and sliding movement thereon, a pair of sleeves positioned on either side of said frame for selectively restricting the sliding movement of said frame along said horizontally extending shaft, selectively operable means for frictionally engaging said shaft to hold said sleeves in position on said horizontally extending shaft; and a turnbuckle with one end connected to said frame at the end away from said horizontal shaft and the other end connected to a support means extending above said work surface for selectively controlling said wheel in a position with respect to said workpiece as said workpiece translates through said sanding station.

2. A sander for shaped grooves extending across a workpiece comprising in combination:

feed means to move a train of said workpieces through a sanding station with said grooves aligned and parallel to the direction of movement;

a sanding wheel contoured to match said groove;

a frame supporting said wheel at one end thereof for rotation on a horizontal axis;

a motor mounted on said frame and coupled to drive said wheel;

a horizontal bar slidably and pivotally supporting said frame at the end opposite said wheel to rotate about a horizontal axis;

sleeves on said bar positioned on either side of said frame, and selectively operable means on said sleeves for frictionally engaging said bar; and a variable length link extending downward to said frame to control the depth said wheel is positioned with respect to said workpiece.

* * * * *